US006712605B2

(12) United States Patent
Moresco

(10) Patent No.: US 6,712,605 B2
(45) Date of Patent: Mar. 30, 2004

(54) GAS BURNER FOR A COOKING HOB

(76) Inventor: Paolo Moresco, Via 51° Btg. Bersaglieri, 36063 Marostica (IT)

( * ) Notice: Subject to any disclaimer, the term of this patent is extended or adjusted under 35 U.S.C. 154(b) by 0 days.

(21) Appl. No.: 10/148,540

(22) PCT Filed: Apr. 17, 2001

(86) PCT No.: PCT/IB01/00624

§ 371 (c)(1),
(2), (4) Date: May 31, 2002

(87) PCT Pub. No.: WO01/84049

PCT Pub. Date: Nov. 8, 2001

(65) Prior Publication Data

US 2003/0000512 A1 Jan. 2, 2003

(51) Int. Cl.[7] ..... F23D 14/06
(52) U.S. Cl. ..... 431/354; 126/39 E
(58) Field of Search ..... 431/266, 286, 431/354; 126/39 E; F23D 14/06

(56) References Cited

U.S. PATENT DOCUMENTS 4,485,972 A * 12/1984 Freber ..... 239/553.3
5,139,417 A 8/1992 Ghassemzadeh
5,488,942 A * 2/1996 Maughan ..... 126/39 E
5,846,071 A 12/1998 Sigler
6,067,978 A * 5/2000 Schlosser et al. ..... 126/41 R
6,146,132 A * 11/2000 Harneit ..... 431/354
6,244,263 B1 * 6/2001 Schlosser et al. ..... 126/39 R

FOREIGN PATENT DOCUMENTS

DE 19751008 C 4/1999
EP 0485645 A 5/1992
EP 0908682 A 5/1992
WO 2256268 A * 12/1992 ..... F24C/3/08
WO WO 9812475 A1 * 3/1998 ..... F23D/14/06
WO WO 9911975 A1 * 3/1999 ..... F23D/14/06

* cited by examiner

*Primary Examiner*—Henry Bennett
*Assistant Examiner*—James G. Barrow
(74) *Attorney, Agent, or Firm*—R. Neil Sudol; Henry D. Coleman; William J. Sapone

(57) ABSTRACT

Gas burner for a cooking hob, comprising a burner body provided with a plurality of openings for entry of primary air, a flame-dividing element which defines together with the burner body and air/gas mixing chamber, a gas injector which is mounted on the cooking hob, for injecting gas inside the mixing chamber, and a converging/diverging duct which defines a Venturi tube located downstream of the gas injector for drawing air into the mixing chamber. In accordance with the present invention, the burner body, the flame-dividing element and the converging/diverging duct consist of a single monolithic structure in the form of a pressed sheet-metal casing.

15 Claims, 4 Drawing Sheets

GAS BURNER FOR A COOKING HOB

FIELD OF THE INVENTION

The present invention relates to a gas burner for a cooking hob, intended to be used advantageously in any type of gas cooker, in particular of the household type, for cooking food products.

BACKGROUND ART

As is known, burners are conventionally mounted on cooking hobs, opposite gas injection nozzles.

In greater detail, each burner is formed by a plurality of components which can be separated from each other and suitably assembled so as to form the burner as a single unit which allows in particular correct mixing between the air and gas and consequent optimum combustion of the mixture thus obtained.

In accordance with the art known hitherto, each burner is conventionally composed of a bowl (or cup) fixed to the cooking hob and provided on the bottom with a gas injection nozzle, a mushroom-shaped burner body which can be inserted inside the cup and a flame-dividing element which can be mounted on the burner body and associated at the top with a top piece.

The burner body, in turn, is conventionally composed of a hollow axial shank provided with a plurality of side openings for entry of the air and by an overlying disk-shaped portion having an annular seat for receiving the flame-dividing element. The latter is of a type known per se and is provided with a series of orifices for the outflow of the air/gas mixture.

During operation, the shank is inserted inside the cup until the bottom surface of the disk-shaped portion rests against the top of the said cup.

As is known, moreover, the shank generally has a frustoconical shape with a bottom opening having a smaller cross-section arranged in a position facing the gas-injection nozzle. In this way, the flow of gas inside the shank causes a Venturi effect with consequent drawing of primary air via the side openings.

Essentially all the burners of the known type perform air/gas mixing by means of the Venturi effect using a tubular element which is positioned vertically with respect to the burner and in line with the outflow of the gas from the nozzle.

Numerous configurations of burners with different arrangements of the openings for the flow of the primary air intended to be mixed with the gas supplied from the nozzle are known. In particular, a burner configuration is known whereby the shank is arranged facing the nozzle at a certain distance therefrom so as to allow air to be drawn directly through the bottom opening of the shank.

This latter burner embodiment is described and illustrated in European patent EP-B-0,485,645.

Burners in which the flame-dividing element forms a single body with the burner body are also known, being made as one piece by means of a die-casting process. In this case the disk-shaped portion of the burner body incorporates the flame-dividing element in a single unit.

In practice, the burners of the known type, described in brief above, have numerous drawbacks.

A major drawback of these burners of the known type consists in the fact that they have a large number of constructional components. This fact means that a not insignificant amount of time is required in order to assemble the individual components as a single unit. Moreover, often an excessive amount of time is required in order to assemble burners of the known type on the cooking hobs.

The presence of numerous constructional components also poses an intrinsic operational difficulty every time it is required to assemble or disassemble the burner, for example for maintenance or routine cleaning purposes.

A further drawback of burners of the known type consists in the fact that the production of the individual components is performed by means of die-casting processes which per se are complex and such that they increase the overall production costs of burners of the known type.

Generally, moreover, these components are made of pressure-cast aluminium which, as is known, has a limited duration over time, among other things being able to be easily corroded by the cleaning agents which are widely used.

All these disadvantages therefore constitute an obvious limitation of the burners of the known type which may have a significant negative effect on the entire burner manufacturing process.

It should be noted, finally, that, owing to the vertical insertion of a Venturi tube, the height of the burner may result in an excessive volume occupied by the burner on the cooking hob.

SUMMARY OF THE INVENTION

The main object of the present invention is therefore that of eliminating the drawbacks of the prior art mentioned above by providing a gas burner for a cooking hob, which is simple and inexpensive to manufacture and allows rapid assembly of its constructional components.

Another object of the present invention is to provide a gas burner which is easy to assemble and/or disassemble and which allows rapid maintenance and cleaning operations.

Another object of the present invention is to provide a gas burner which has small overall dimensions with, in particular, a low height.

Another object of the present invention is to provide a gas burner which has a small number of constructional components.

Another object of the present invention is to provide gas burner which is long-wearing over time and which is made of material able to resist the cleaning agents which are commonly used.

A further object of the present invention is to provide a burner which is simple from a constructional point of view and operationally entirely reliable.

These objects, together with others, are all achieved by the gas burner for a cooking hob which, in accordance with the present invention, comprises a burner body provided with at least one opening for entry of primary air, a flame-dividing element defining together with the burner body an air/gas mixing chamber, a gas injector intended to be mounted on the cooking hob in order to inject gas inside the mixing chamber, and a converging/diverging duct defining a Venturi tube located downstream of the gas injector for drawing air into the mixing chamber, characterized in that he burner body, the flame-dividing element and the converging/diverging duct consist of a monolithic structure in the form of a pressed sheet-metal casing.

As a result of this gas burner the number of constructional components is reduced, allowing more economical and faster and simpler assembly.

BRIEF DESCRIPTION OF THE DRAWINGS

Further features and advantages of the present invention will more clearly understood in the light of a preferred embodiment of a burner for cooking hob given by way of non limiting example with reference to the accompanying drawings, in which.

DETAILED DESCRIPTION OF THE PREFERRED EMBODIMENT

With reference to the accompanying drawings, 1 denotes in its entirety a burner for a cooking hob according to the present invention.

Figure 1:
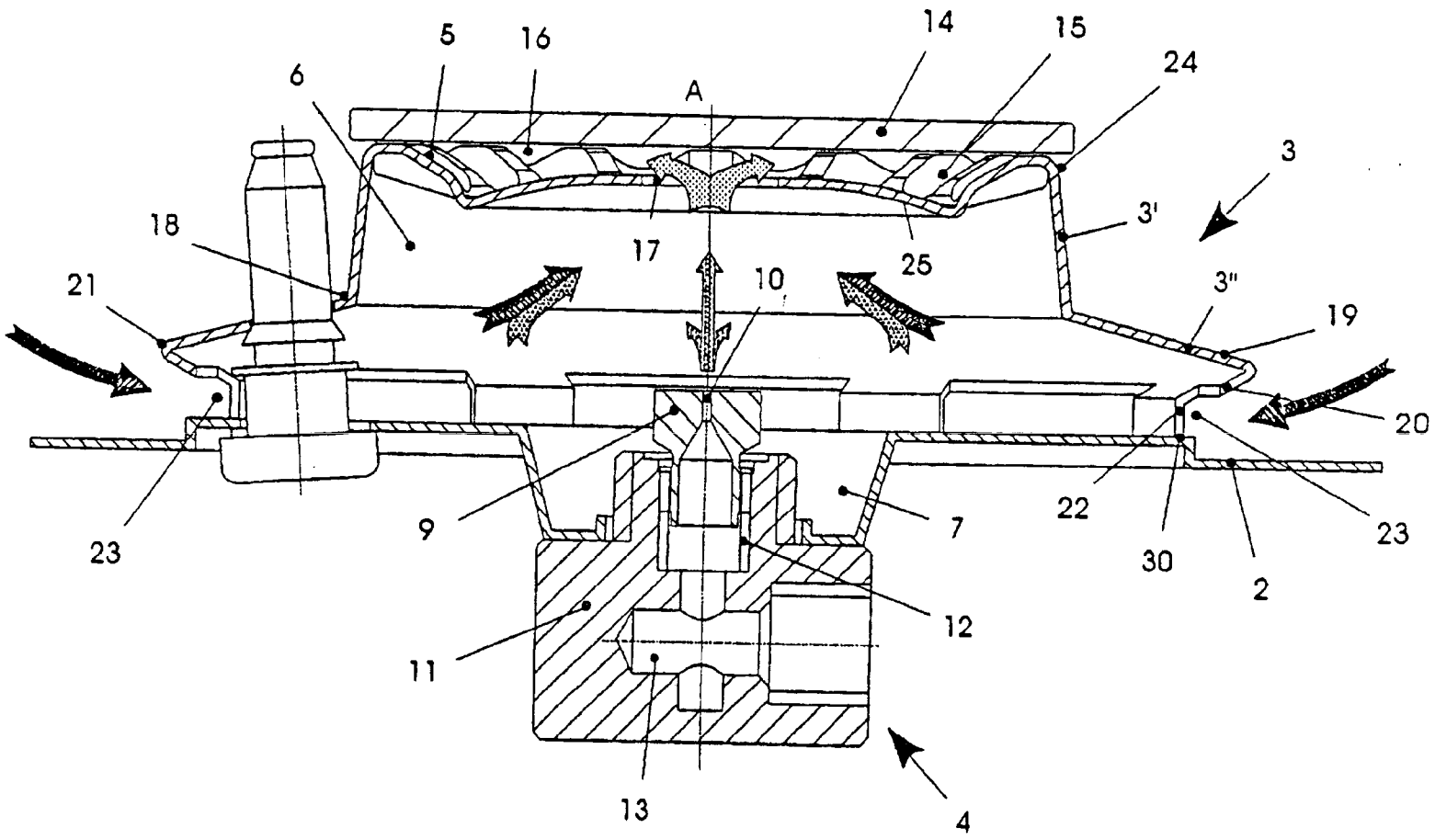
FIG. 1 shows a cross-sectional side view of the gas burner according to the present invention, mounted on a cooking hob.

This burner 1 is suitable for use advantageously on a cooking hob 2, of the type partially illustrated in FIG. 1 and for example designed for use in gas cookers so as to allow in particular the heating, in a known manner, of any kind of food product.

With particular reference to the accompanying FIG. 1, the burner 1 comprises a burner body 3 resting on the cooking hob 2 in a position centred around a gas injector 4, and a flame-dividing element 5 mounted on top of the burner body 3 so as to define therewith and with the cooking hob 2 an air/gas mixing chamber 6.

Figure 2:
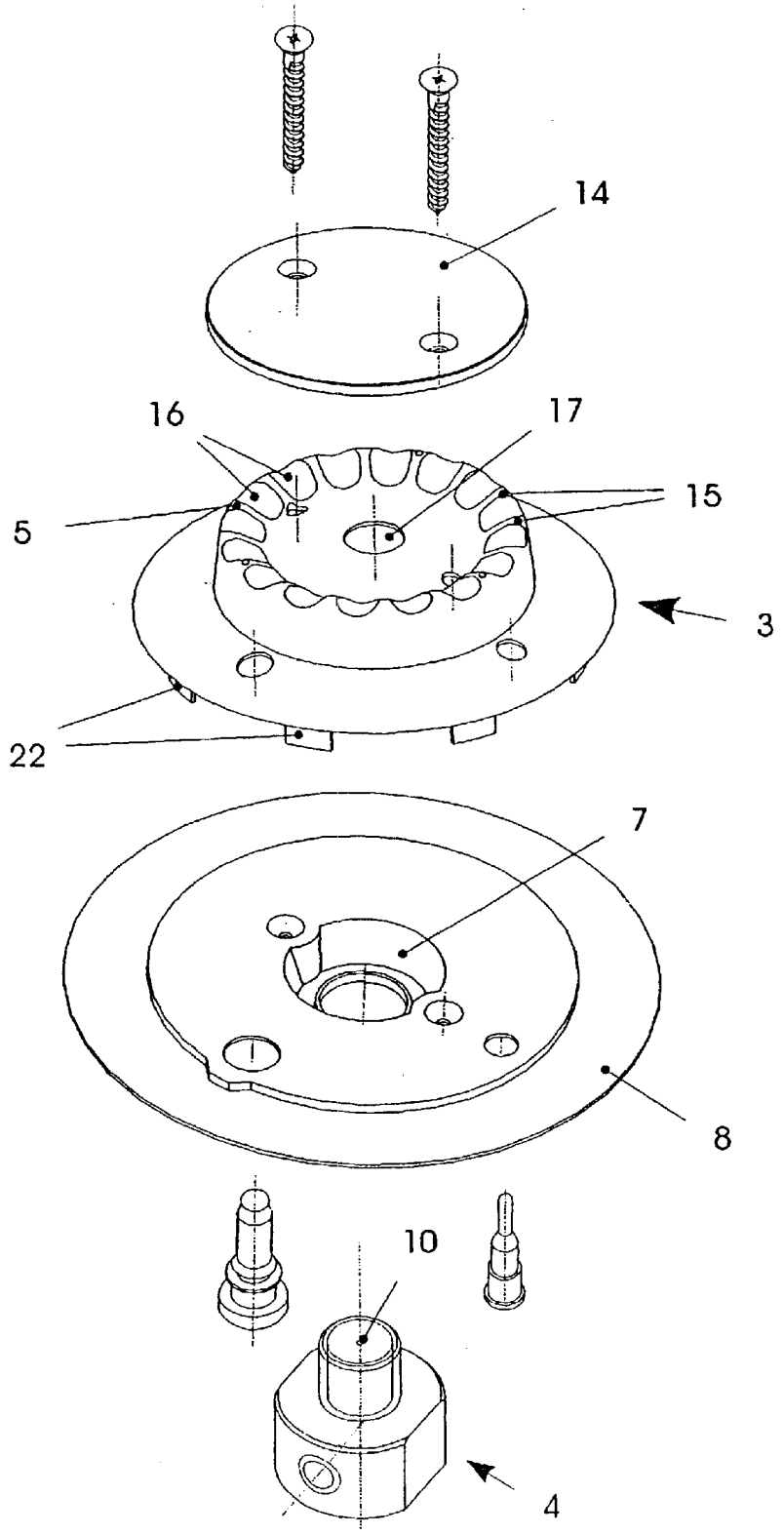
FIG. 2 shows an exploded perspective view of the burner-in question.
Figure 3:
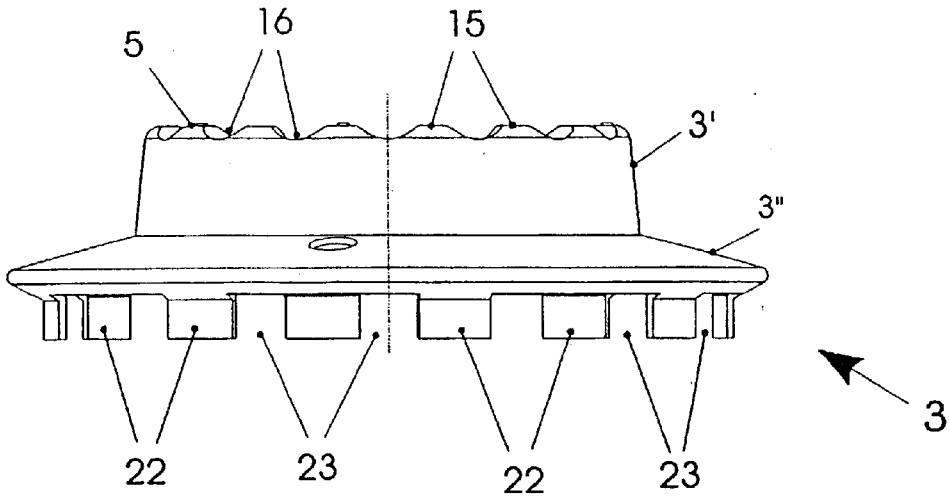
FIGS. 3 and 4 show, respectively, a side view and a plan view of a constructional detail of the burner in question associated with a burner body.
Figure 4:
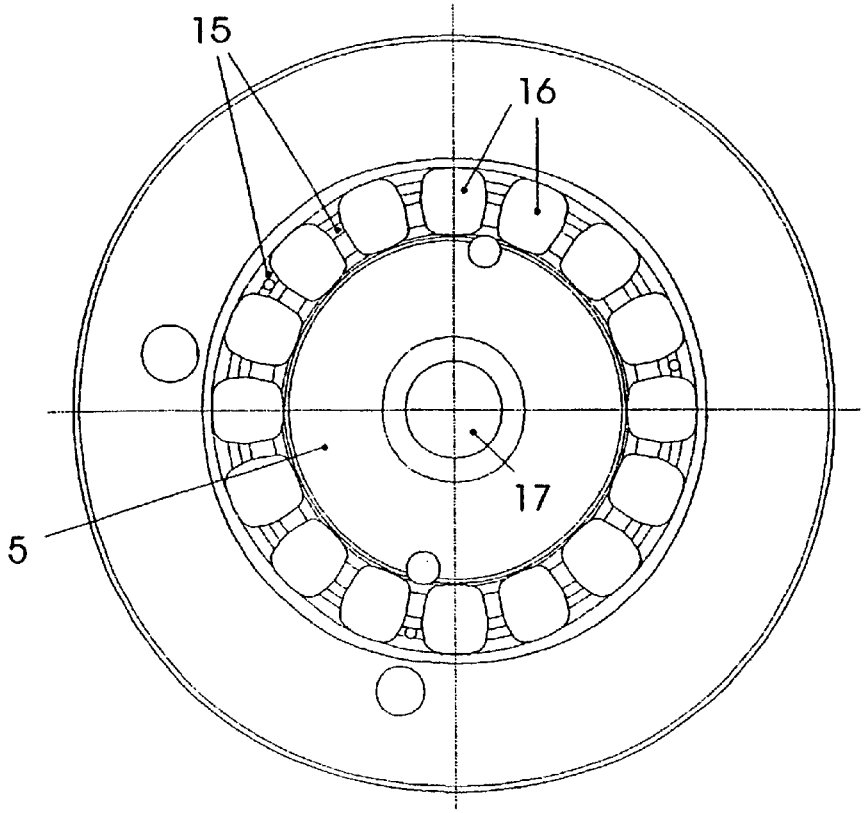
Figure 5:
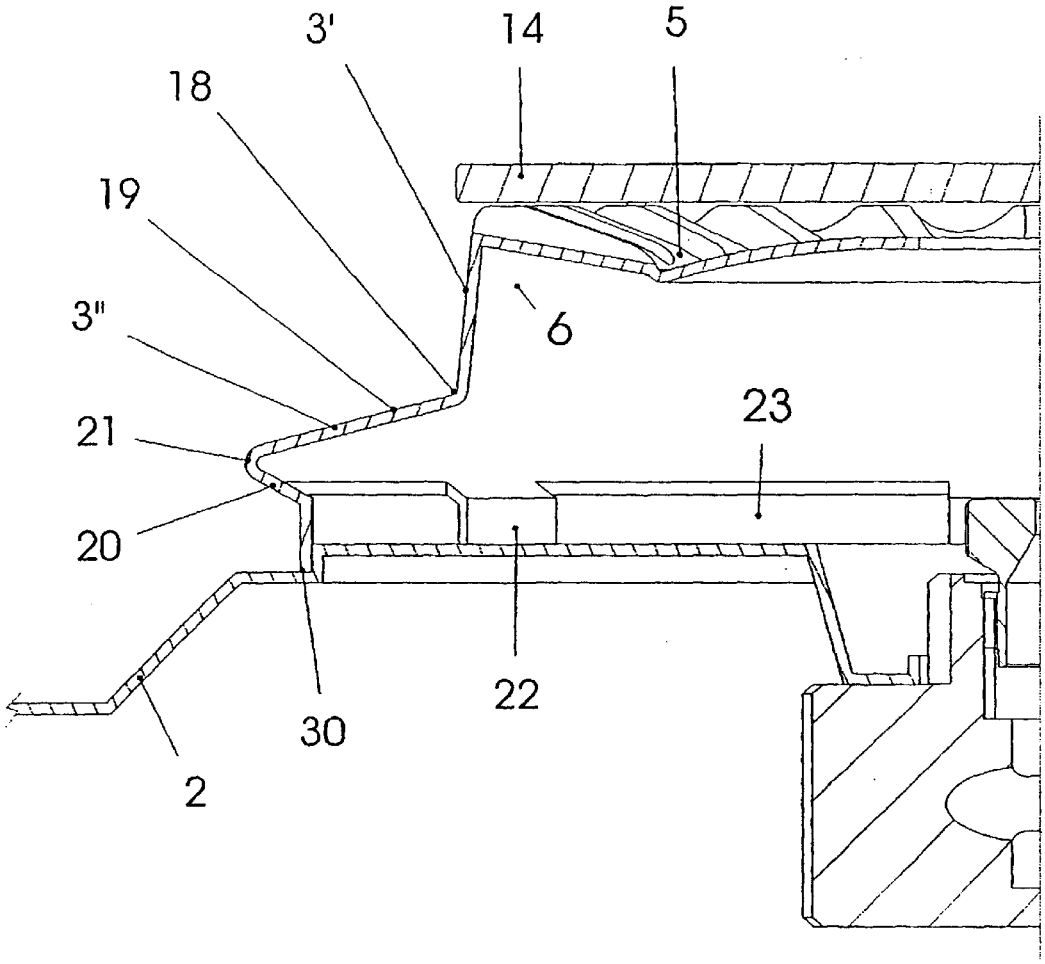
FIG. 5 shows a cross-sectional side view of an enlarged detail of FIG. 1, relating to the mounted arrangement of a burner body on a cooking hob.

In accordance with the example of embodiment illustrated in FIGS. 1 and 2, the gas injector 4 is mounted in a seat 7 formed directly on the cooking hob 2. The gas burner 3 is, in turn, arranged centred around the gas injector 4 and rests on the cooking hob 2 by means of annular contact surface 30 (see FIG. 5). For the sake of greater clarity it is pointed out that, in FIG. 2, 8 denotes a portion of the cooking hob 2.

In greater detail, in the non-limiting example of embodiment illustrated in FIG. 1, the gas injector 4 has a gas outlet nozzle 9 with an orifice 10 directed upwards inside the mixing chamber 6 and a supporting body 11 provided with a seat 12 able to contain the nozzle 9 and connected by means of a duct 13 to gas supply means, not shown in that they are of a type known per se.

A top piece 14 is mounted so as to rest on top of the flame-dividing element 5 and defines, by means of fins 15 formed above the flame-dividing element 5, outlet ducts 16 for the air/gas mixture.

Openings 23 which are advantageously distributed at regular intervals around the burner body 3 are formed in the burner body 3, as will emerge more clearly below when the form of the burner body 3 itself will be defined in detail.

The burner 1 moreover defines with its components a converging/diverging duct which can be assimilated to a Venturi tube located downstream of the gas injection nozzle 9 and can be operationally used to draw air into the mixing chamber 6 via the openings 23.

The configuration of this converging/diverging duct will specified more clearly below.

According to the invention, the burner body 3, the flame-dividing element 5 and the converging/diverging duct consist of a single monolithic structure in the form of a pressed sheet-metal casing. In particular, the metal sheet may be advantageously made of steel.

The flame-dividing element 5 has a central hole 17 which is centred around the central axis A of symmetry of the burner 1 and faces frontally the gas injection nozzle 9.

In greater detail, in accordance with a preferred embodiment of the present invention, the burner body 3 is essentially composed of a frustoconically shaped upper portion 3' which is tapered at the top and delimited by the flame-dividing element 5, and by a lower portion 3" which extends continuously from the upper portion 3' by means of a first fold 18 in the sheet metal and extends substantially on the outside of the upper portion 3', radially widening the form of burner body 3.

In turn, the lower portion 3" has, extending from the upper portion 3', a first section 19 inclined outwardly of the burner 1 and a second section 20 extending from the first section 19 and inclined inwardly of the burner 1. The two sections 19 and 20 are connected together in a continuous manner and are formed by means of a second fold 21 in the sheet metal.

The bottom edge of the second section 20 has, extending from it, in a substantially vertical manner as far as the cooking hob 2, a plurality of teeth 22 between which the abovementioned openings 23 for the flow of air inside the mixing chamber 6 are defined (see FIG. 2).

Obviously, without departing from the scope of protection of the present patent, the shape of the burner body 3 may also be different from that illustrated above and in particular may also be simply cylindrical or frustoconical.

Advantageously, these openings 23 may be easily obtained during the pressing step of the production process.

The flame-dividing element 5 extends in a mainly horizontal direction and is peripherally joined to the burner body 3 by means of a third fold 24 in the sheet metal. The central part of the flame-dividing element 5 is occupied by a conveying portion 25 in the form of a dome with a central hole 17 and with its concavity directed towards the inside of the mixing chamber 5.

Obviously, it is possible to devise a different shape for the conveying portion 25 of the flame-dividing element 5 (for example a frustoconical shape) without thereby departing from the scope of protection of the present invention.

The converging/diverging duct mentioned above is defined by the conveying portion 25 which forms the converging section of the duct, by the central hole 17 which forms the narrowest section of the duct and by the ducts 16 for the outflow of the air/gas mixture which form the diverging section of the duct.

Functionally speaking, the gas is emitted from the nozzle 4 into the mixing chamber 6 where it is mixed, in the correct proportions, with the air for producing a suitable mixture which is conveyed by the conveying portion 25 through the central hole 17, from where it then spreads into the outlet ducts 16. The constriction due to the presence of the central hole 17 and the subsequent widening of the gas flow cross-section due to the form of the outlet ducts 16 results in the creation of a Venturi effect with consequent drawing of air inside the mixing chamber 6 via the openings 23 formed radially on the burner body 3.

It should be noted finally that, in accordance with the present invention, the configuration of the burner 1 described hitherto requires the manufacture of a limited number of constructional components since, in particular, the flame-dividing element 5 and the burner body 3 are formed as one piece by means of processes involving the pressing of a steel sheet. This possibility of forming the burner 1 with a limited number of constructional components obviously also results in major cost-related advantages.

Moreover, since there is no Venturi tube in the form of a vertical element, it is possible to produce burners with a lower height and, ultimately, smaller dimensions.

The invention thus conceived therefore achieves the predefined objects. Obviously it may also assume, in its practical embodiment, forms and configurations different from those illustrated above without thereby departing from the present scope of protection.

Moreover, all the details may be replaced by technically equivalent elements and the dimensions, the forms and the materials used may be any in accordance with requirements.

What is claimed is:

1. Gas burner for a cooking hob (2), comprising:

a burner body (3) provided with at least one opening (23) for entry of primary air;

a flame-dividing element (5) defining together with said burner body (3) an air/gas mixing chamber (6), said flame-dividing element (5) having a conveying portion (25) facing said mixing chamber (6), said conveying portion (25) converging upwardly to a hole (17) disposed centrally in said flame-dividing element (5), whereby a gas-air mixture in said mixing chamber (6) is funneled directly to said hole (17) along said conveying portion (25), said flame-dividing element (5) being provided on an upper side with a plurality of outlet ducts (16) communicating with said hole;

a gas injector (4) intended to be mounted on said cooking hob (2), for injecting gas inside said mixing chamber (6);

said burner body (3) and said flame-dividing element (5) consisting of a monolithic structure in the form of a pressed sheet-metal casing; and said air/gas mixing chamber (6) extending entirely above the cooking hob (2).

2. Burner according to claim 1, further comprising a top piece (14) disposed on said flame-dividing element (5) so as to define therewith said outlet ducts (16).

3. Burner according to claim 1, wherein said hole (17) substantially faces said gas injector (4).

4. Burner according to claim 1, wherein said conveying portion (25) has a frustoconical or dome shape.

5. Burner according to claim 1, wherein said burner body (3) is provided with an annular contact surface (30) engageable with said cooking hob (2).

6. Burner according to claim 1, wherein said burner body (3) comprises an upper substantially frustoconical portion (3') tapered at the top and delimited by said flame-dividing element (5), and a lower portion (3") extending continuously from the upper portion (3') by means of a first fold (18) in the sheet metal and extending substantially outwards with respect thereto, widening radially the form of said burner body (3).

7. Burner according to claim 6, wherein said lower portion (3") comprises a first section (19) extending from said upper portion (3') and inclined outwardly of the burner (1) and further comprises a second section (20) extending from said first section (19), inclined inwardly of said burner (1) and continuously connected at an angle with said first section (19) by means of a second fold (21) in the sheet metal.

8. Burner according to claim 7, wherein said upper portion (3') and said flame-dividing element (5) are peripherally connected together continuously by means of a third fold (24) in said sheet metal.

9. Burner according to claim 7, wherein said burner body (3) is provided with a plurality of openings (23) for entry of primary air and wherein a plurality of teeth (22), which define said openings (23) with a cooking hob (2), extend from said second section (20) of said lower portion (3") of said burner body (3) descending substantially vertically until to rest against said cooking hob (2).

10. Burner according to claim 1, wherein said conveying portion (25), said hole (17), and said outlet ducts (16) form a converging/diverging duct (16, 17, 25) defining a Venturi tube located downstream of the gas injector (4) for drawing air into said mixing chamber (6).

11. Burner according to claim 10, wherein said air/gas mixing chamber (6) extends entirely above the cooking hob (2), said converging/diverging duct (16, 17, 25) extending in substantially radial directions with no vertical element in such a manner to reduce the overall height and the dimensions of the burner and allow the burner to be mounted on a cooking hob of reduced height.

12. Burner according to claim 10, wherein said conveying portion (25) forms a converging section of said converging/diverging duct (16, 17, 25).

13. Burner according to claim 1, wherein said mixing chamber (6) is delimited laterally by said burner body (3), at the top by said flame-dividing element (5) and at the bottom by said cooking hob (2).

14. Burner according to claim 1, wherein said burner body (3) has a substantially cylindrical or frustoconical shape.

15. Burner according to claim 1, wherein said at least one opening (23) is obtained by means of pressing of the sheet metal.

* * * * *